United States Patent [19]

Ball

[11] 3,973,746

[45] Aug. 10, 1976

[54] COLLISION AVOIDANCE SYSTEM

[75] Inventor: Kenneth H. Ball, Tarzana, Calif.

[73] Assignee: Walt Disney Productions, Burbank, Calif.

[22] Filed: May 2, 1975

[21] Appl. No.: 573,847

[52] U.S. Cl. ..... 246/187 B; 104/149; 246/34 R; 246/63 C

[51] Int. Cl.[2] ..... B61L 3/10; B61L 3/20

[58] Field of Search ..... 246/33 R, 34 R, 63 R, 246/63 C, 130 R, 167 D, 187 R, 187 B, 187 C, 34 CT, 122 R; 340/23, 171 R, 171 A; 104/149, 152, 153

[56] References Cited

UNITED STATES PATENTS

| | | | |
|---|---|---|---|
| 3,035,167 | 5/1962 | Luft | 246/130 R |
| 3,303,339 | 2/1967 | Dell | 246/63 C |
| 3,355,584 | 11/1967 | Baughman | 246/187 B |
| 3,794,833 | 2/1974 | Blazek et al. | 246/63 C |

*Primary Examiner*—Stephen G. Kunin
*Attorney, Agent, or Firm*—Fulwider, Patton, Rieber, Lee & Utecht

[57] ABSTRACT

A collision avoidance system adapted for railroad use comprising a track having connected thereto a plurality of first signal transmitters exciting the track by a first control signal within a first frequency bandpass range and a plurality of second signal transmitters interspaced between the first signal transmitters in an alternating arrangement, such second transmitters exciting the track by a second control signal within a second frequency bandpass range. While the first and second control signals are respectively within the first and second bandpass range, individual ones thereof are separated by frequency increments from the other control signals within the corresponding bandpass range such that any beats therebetween are of a relatively high frequency. A train riding the track includes a front and rear pickup selectively connected to a dual frequency amplifier across a two-position switch where the amplifier, at its output, connects to a first and second bandpass filter respectively centered at the first and second frequency bandpass. The outputs of the respective filters are rectified and fed to corresponding comparators wherein the signals are compared against a preselected level. The outputs of the comparators are then combined in a logical AND circuit which, across a delay network having a long time constant in the direction of brake engagement and a short time constant in the direction of brake disengagement, operates the brakes of the train. Included also in the train, intermediate the front and rear pickups, is a shunt circuit including the motor of the train, whereby the control signals are attenuated. Thus, the next succeeding train will not receive the shunted control signals and will therefore engage the brakes.

15 Claims, 8 Drawing Figures

COLLISION AVOIDANCE SYSTEM

BACKGROUND OF THE INVENTION

1. Field of the Invention

The present invention relates to proximity signaling systems, and more particularly to collision avoidance systems adapted for railway use.

2. Description of the Prior Art

The use of an overhead line, a power bus, or the rails themselves of a track as a conduit for signals in a railway system has been known in the past. Such signals have served various purposes, including the purpose of automatic control over train density and collision avoidance. Often such control or proximity signals are present on the rails along with electrical power transmission which provides the motive power to the train and in such combination the power signal and the control signals are generally separated by frequency.

Most often, D.C. electrical power is used for traction and the control signals are in the form of alternating electrical signals superposed over the D.C. signal by either a single or a plurality of signal transmitters. In order to obtain good isolation between any noise associated with a D.C. signal source and the control signals, the transmitters connected to the track are typically operating at a relatively high frequency. Such transmitters, furthermore, were often connected to A.C. isolated segments of track in order to limit interference between transmitted signals thereof.

Thus the track generally was divided into A.C. isolated sections, each section connected to a control signal transmitter generating an alternating signal, each section being furthermore powered by a D.C. power source. As the train passed, or was within a particular section of track, a trainborne receiver would pick up the superposed control signals and in many applications would modify such control signal. A second train, therefore, appearing on the same segment of track would see an altered control signal and upon detecting the alterations therein would thus detect the presence of the other train.

The difficulty with the arrangement described above is that the track has to be segmented into discrete A.C. isolated sections and therefore instances can occur where two trains can be immediately adjacent across the A.C. isolation device and still not sense the relative presence of each other.

For that reason, a further improvement has been made in the recent past wherein the track sections are A.C. coupled and the impression of the A.C. signal thereon will therefore follow the normal loss with distance, or attenuation with distance, function as result of coupling between the conduits, and other losses. A train straddling the conduits would present additional attenuation and thus register its presence.

The difficulty with this arrangement, however, is that the loss or attenuation along the conduits combines with the other transmitted signals and the combination varies quite significantly with changes in atmospheric conditions and ground conditions between such conduits. Thus a direct reading of the signal amplitude does not provide a sufficiently accurate indication of the close presence of adjacent trains. For that reason, use of repeated single frequency transmissions has been abandoned in favor of a plural frequency transmission arrangement where transmission of one frequency is alternated with transmissions of other frequencies along the track. Thus within a particular segment of the track there will be at least two control signals, one possibly attenuated more than the other, which are, however, above a minimal amplitude necessary for sensing when not straddled by a train. Thus when both such signals are present, the sensors on the train identify a safe condition. For the purposes referred to herein, it is to be understood that the word "section" no longer refers to an A.C. or D.C. isolated segment of track, but is instead related to a section of track within which the control signal levels are above a predetermined amplitude.

Thus, systems have been devised in the past where at least two distinct frequency control signals are alternatively impressed onto the track, on a recurring basis, such that the conduits of the track always carry locally transmitted control signals above a predetermined signal level, unless shorted by the train. The repeated superposition of such signals onto the conduits, however, requires a plurality of independent external signal sources or transmitters which, although alternatively distinct in frequency, must be within a small frequency separation gap so that the normal frequency dependent attenuation thereof is substantially identical.

Thus, prior art level or amplitude responsive trainborne receivers are generally effective only if the two signal frequencies are close. Where the frequencies are close, the ability of isolating the two specific signals becomes critical. Thus, the trainborne sensors picking up such transmitted signals require narrow bandwidth filters, with which comes the problem of beats between the locally superposed signals and the more remote signal sources of the same frequency.

SUMMARY OF THE INVENTION

Accordingly, it is the general purpose and object of the present invention to provide a dual frequency bandpass train control system wherein the repeated signals of one frequency bandpass are separated by frequency increments of a bandwidth higher than the train response bandwidth.

Further objects of the invention are to provide a collision avoidance system which utilizes control signals of two distinct frequency bandpasses superposed alternatively onto the conduits of a track.

Other objects of the invention are to provide a train collision avoidance system which is fail safe, easy to produce, and which requires few parts.

Briefly, these and other objects are accomplished within the present invention by providing a plurality of wayside transmitters disposed along a railroad track, each transmitter being connected between the conduits of the track and superposing an electrical signal of a particular frequency thereon. Included in the train are a front and rear pickup, each disposed to sense the signals superposed on the conduits, the pickups being selectively connected across a two-position switch to an amplifier. The output of the amplifier is in turn connected, in parallel, to two narrow bandpass filters centered respectively at a first and second bandpass range. The respective outputs from each filter are then rectified and compared against preselected levels in corresponding comparators. When above the preselected levels, the outputs of the comparators are collected at the inputs of a logical AND circuit which, across a delay circuit, engages the brakes of the train. The delay circuit provides a slow time constant in the engagement direction, such that spurious engagements due to noise are avoided. The individual transmitter frequencies are generally grouped within a first and second frequency bandpass respectively entered about the centers of the two filters, and transmitters of one bandpass are alternated with transmitters of another bandpass along the track. These alternated transmitters are connected to the track at relatively large spacing increments, e.g., 500 feet to 1000 feet, and their respective signals, therefore, decay with distance as result of the normal inductive and capacitive attenuation between the conduits.

Within each bandpass range the adjacent transmitters of one general frequency are also frequency separated by frequency intervals, or beat frequencies, which are higher than the engagement time constant of the delay circuit. Thus any phase changes due to the attenuation along the track, which at identical frequencies would tend to cancel the signal from one transmitter by that of another, are effectively decoupled by the frequency separations within the bandpass.

In addition, the conduits are excited by a D.C. source which provides the motive power to the trains. To preclude total propulsive failure in the case of a local short or other anomalies along the track, the track is conventionally divided into D.C. isolated segments, each powered separately by a source of D.C. power, each segment being further A.C. coupled with the adjacent segments to transmit the alternating signals from the transmitters.

The trains, in addition to the receivers described above, further each include an attenuating circuit, including the electric motors of the trains, disposed between the front and rear pickups across the conduits whereby the alternating signal levels from the transmitters are attenuated behind the pickup. Thus, as one train is within the track section between adjacent transmitters, the succeeding train will only sense signals from the unattenuated transmitters. In this event, the required signal level of at least one transmitter falls below the threshold amplitude of the comparator, thus allowing the brakes to engage.

The track, by virtue of its layout, provides both a series and a parallel attenuation path, the series path occurring by virtue of mutual inductance components and the parallel path being primarily formed by the air gap between the two conduits. Since the parallel attenuation path is mostly in capacitive form, the amount of attenuation thereacross is therefore highly frequency dependent. Accordingly, the alternating control signals superposed onto the track must necessarily be of a frequency which, although separate and distinct, is close to the other frequencies. Thus, in order to insure that any beats that do occur occur only above the filtering cutoff frequency of the delay circuit, the repeated control signal is at a signal frequency which is not exactly the same as the prior signal source within the same bandpass. The separation frequency is, however, intentionally larger than the engagement time constant, or the engagement bandpass, of the delay circuit to preclude the possibility of low frequency beats which would be passed to activate the brakes.

DESCRIPTION OF THE SPECIFIC EMBODIMENT

While particular reference in the following description is made to a railroad collision avoidance system, such is for illustrative purposes only. It is to be noted that the general system approach may have wider applications, and no intent to limit the scope of the invention is expressed by way of these teachings.

Figure 1:
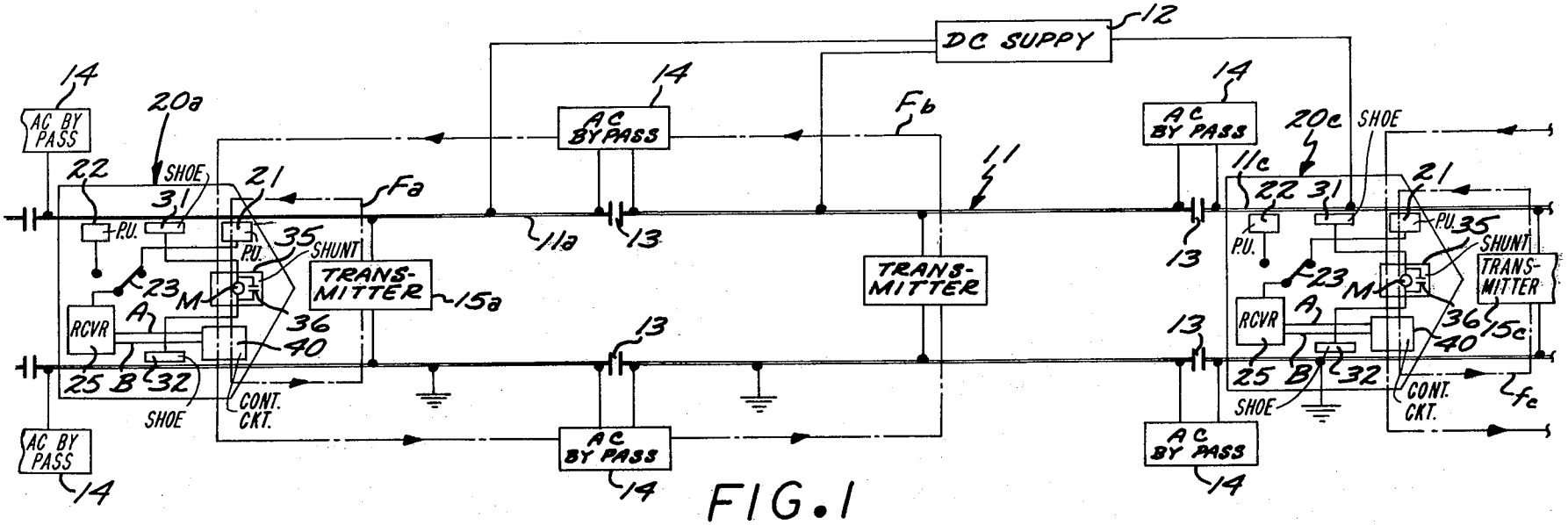
FIG. 1 is a diagrammatic illustration of a track carrying trains and incorporating an inventive collision avoidance system operating with two successive trains separated by a safe distance.

As shown in FIG. 1, a monorail track, generally designated by the numeral 11, includes D.C. isolated power bus, or conduit, sections 11*a*, 11*b* and 11*c*, each separately connected for excitation to a D.C. power supply 12. While practiced in a monorail application, any dual conduit service best illustrates the invention by reference to D.C. isolated track sections, where the conduits of track 11 also carry power and are shown separated by gaps 13 around which an A.C. bypass circuit 14 is connected.

Connected across the conduits, or the equivalent bus sections, of each section of the track is a transmitter designated correspondingly as transmitter 15*a*, 15*b* and 15*c*. Transmitters 15*a*, 15*b* and 15*c* are identical in their circuit structure and are distinct only in the signal frequency that they transmit, and for that reason only one exemplary description thereof is made hereinbelow by way of the description of transmitter 15*a*. It is to be understood that transmitters 15*b* and 15*c* are distinct only in the frequency of the crystal utilized therewith.

Supported on the track 11, and communicating with the conduit section 11*a*, is a train which is shown diagrammatically as a single car and generally designated by the numeral 20*a*. Similarly, on conduit secton 11*c* a diagrammatic single car, generally designated as train 20*c*, is shown. It is to be noted that while trains 20*a* and 20*c* are shown only diagrammatically, all the necessary carrying structure and power structure is subsumed to be included therewith.

Shown within train 20*a* is a front inductive pickup 21 and a rear inductive pickup 22 disposed along one conduit, each respectively connecting to the two contacts of a two-position switch 23. While switch 23 is again diagrammatically illustrated as a single pole switch, switching between the two pickup signals, a signal return is normally necessary, and for that reason a double pole-double throw switch is contemplated and will be so described hereinbelow. The pivot, or arm, of switch 23 is in turn connected to a receiver 25 which, in turn, feeds two signals A and B, separated by bandpass, to a control circuit 40. Shown disposed across the conduits between pickups 21 and 22 are two shoes 31 and 32 respectively contacting the two conduits of section 11*a*. Connected between shoes 31 and 32 is an attenuating circuit, or shunt circuit, 35 formed by the traction motor M of the train and a bypass capacitor 36.

As will be described hereinbelow, transmitters 15*a*, 15*b* and 15*c* each transmit a discrete and separate frequency signal, transmitters 15*a* and 15*c* transmitting signals within a first frequency bandpass range, while transmitter 15*b* transmits substantially a single frequency signal within a second bandpass range. Thus, three separate frequency signals are superposed onto the conduits of the track by transmitters 15*a*, 15*b* and 15*c*, the signals from transmitters 15*a* and 15*c* falling within the first bandpass while the signal from transmitter 15*b* falling within the second bandpass.

The train 20*c* is similarly constructed and therefore includes parts numbered by the same numerals, such as the front and rear inductive pickups 21 and 22 connecting across switch 23 to a receiver 25 and attenuation, or shunt, circuit 35 connected between shoes 31 and 32 which in turn abut, or communicate with, the respective conduits of section 11*c*. It is to be noted that while separate designating numerals are assigned to trains 20*a* and 20*c*, the included functions thereof are essentially identical. More specifically, the function, and the structure, of the inductive pickups, the receiver and the shunt circuit are identical and it is only the instantaneous operation thereof as related to track position that is indicated by way of this numbering system.

Figure 2:
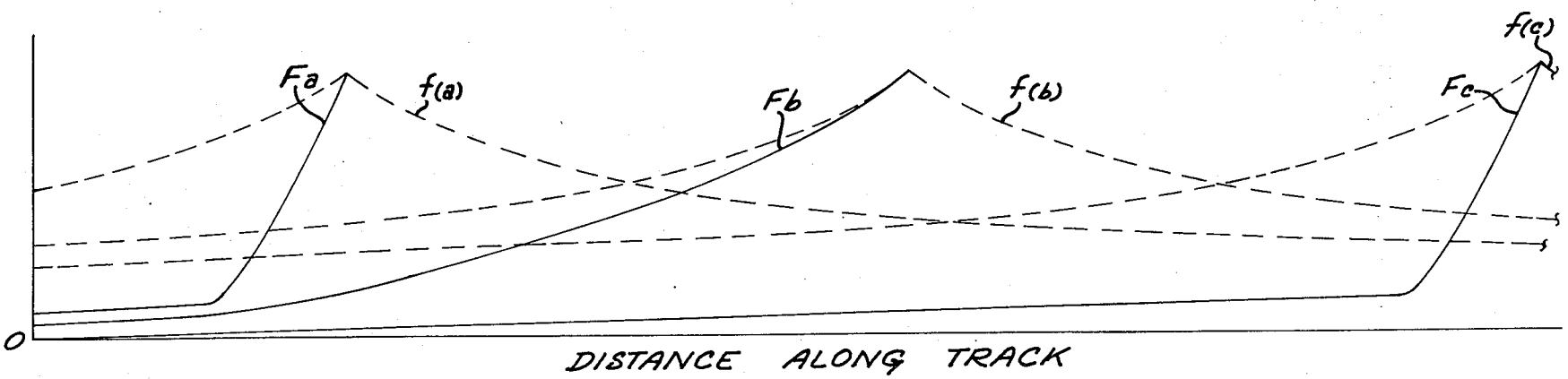
FIG. 2 is a graphical illustration of the decay profiles of the inventive arrangement of various frequency signals both in the presence and out of the presence of the trains.

As shown in FIG. 2, the respective signals from transmitters 15*a*, 15*b* and 15*c* are shown as broken signal charts $f_a$, $f_b$ and $f_c$ decaying in corresponding relationship with distance along the track from a maximum at the transmitter connection. These signal charts are representative of the transmitted signal amplitudes in the absence of any trains and therefore at points further removed from the immediate transmitter connection, attenuation across the conduits takes place. Accordingly, the signal from transmitter 15*a*, identified herein as signal $f_a$, decays along an asymptotic curve with distance from the connection of transmitter 15*a*. Transmitters 15*b* and 15*c* similarly generate respective signals $f_b$ and $f_c$ which, in the absence of the trains, decay again on an asymptotic curve shown in broken lines as signal charts $f_b$ and $f_c$. In this instance it is necessary to note that while the specific frequencies of signals $f_a$, $f_b$ and $f_c$ are distinct, because of the closeness of their spectra the decay functions are essentially similar. Generally, the capacitive and inductive coupling across the conduits is similar and the resulting attenuation of close frequencies with distance is therefore similar.

In the presence of a train, a larger attenuation path is formed through the shunt circuit 35 with the resulting alterations in the decay profiles of signals $f_a$, $f_b$ and $f_c$. These altered signal charts are shown as the solid line signal charts $F_a$, $F_b$ and $F_c$.

Referring back to FIG. 1, the same signal $F_b$, originating from the transmitter 15*b*, is shown passing along one conduit of section 11*b* through the bypass circuit 14, which can be a simple capacitor, to the coupled conduit of section 11*a* to be in turn picked up by shoe 31 and connected across shunt circuit 35 to shoe 32 to return across the bypass circuit 14 on the other conduit back to the transmitter. Similarly, signal $F_a$ is shown emanating from transmitter 15*a* alone one conduit of section 11*a*, again through shoe 31 and across shunt circuit 35 to shoe 32, to return back to the transmitter 15*a*. Thus, shunt circuit 35 in train 20*a* is shown conducting and attenuating both the signals $F_a$ and $F_b$.

Referring again to FIG. 2, the attenuated signals $F_a$ and $F_b$ break at the shunt, thus illustrating a major current path across the shunt.

While the above representation refers to signal potentials, it is to be understood that the inductive pickups 21 and 22 are current responsive and the potential representation is utilized for clarity only, setting forth the new current path formed. The current associated with signals $F_a$, $F_b$ and $F_c$ ahead of the shunt circuit 35 is therefore significantly larger than that behind. Thus the front pickup 21 sees a larger signal than any other pickup behind circuit 35.

As will be observed, both FIGS. 1 and 2 are aligned longitudinally such that the break point of the attenuated signals $F_a$ and $F_b$ occur substantially at the connection, or at the contact, of shoes 31 and 32 with the track section 11*a*. Similarly, the shunt circuit in train 20*c* attenuates the signal $F_c$ from transmitter 15*c*. In addition, the next transmitter ahead is also attenuated in a manner quite similar to the attenuation of signal $F_b$.

Figure 3:
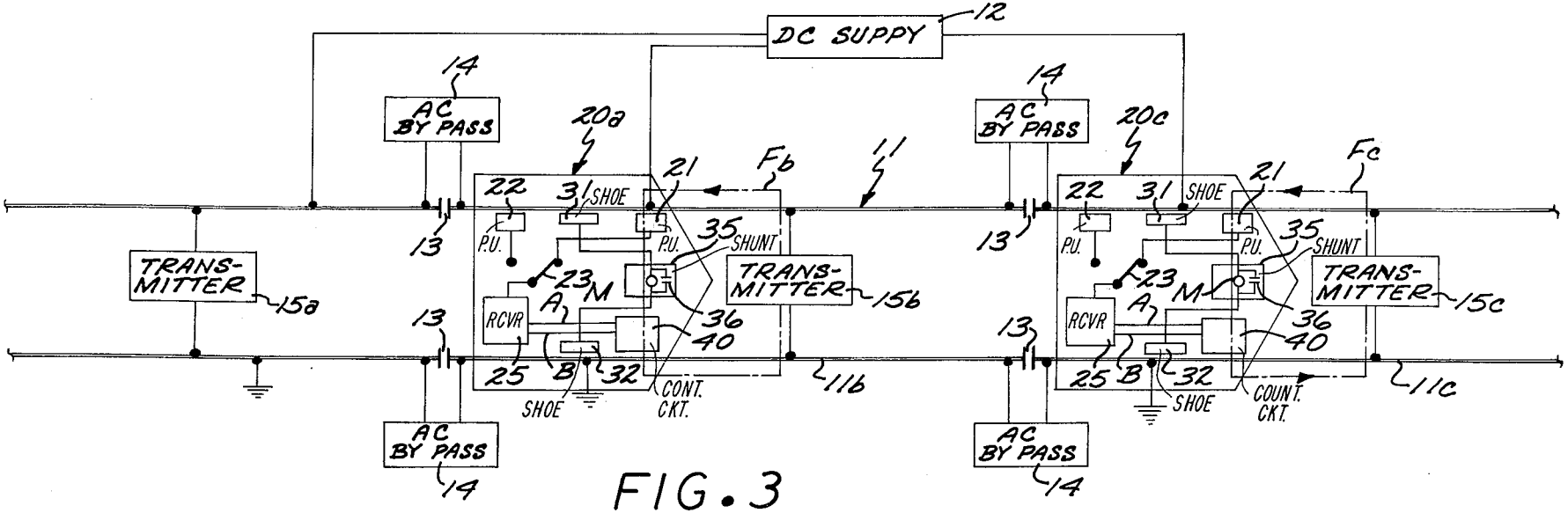
FIG. 3 is yet another diagrammatical illustration of the system shown in FIG. 1, exemplifying an unsafe separation distance between the trains.
Figure 4:
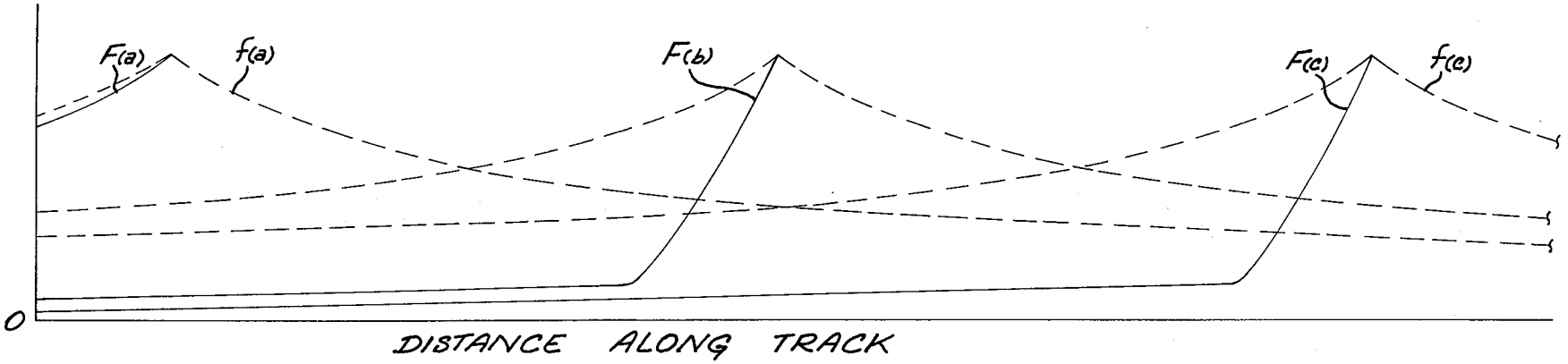
FIG. 4 is a graphical illustration of the signal decay functions shown in FIG. 2 exemplifying the train separation interval shown in FIG. 3.

A similar alignment between the trains, the transmitters and the signal chart is shown in FIGS. 3 and 4. In this illustration, however, train 20*a* is advanced onto section 11*b* and the separation between the trains 20*a* and 20*c* is therefore less than that shown in FIG. 1. For that reason the signal emitted by transmitter 15*c*, or the signal $F_c$, has gone through a gross attenuation by way of the shunt within train 20*c*, such that at the point of interception of train 20*a* the signal from transmitter 15*c* is essentially zero. Train 20*a*, in this position, receives only the signal $F_b$ at any significant magnitude.

Receiver 25 is adapted to receive the signals $F_a$, $F_b$ and $F_c$ at various levels of attenuation and to separate such according to the first and second bandpass range. The corresponding signal amplitudes, separated according to bandpass range, are transmitted out of receiver 25 on signal leads A and B to a control circuit 40. Control circuit 40 in turn controls the forward progression of the train.

With the above general description, the description of the detailed structure of the transmitters is now taken up by way of one example only, it being understood that the same structure can be adapted to generate other frequencies by the simple expedient of a change in a crystal oscillator included therein.

Figures 5, 6:
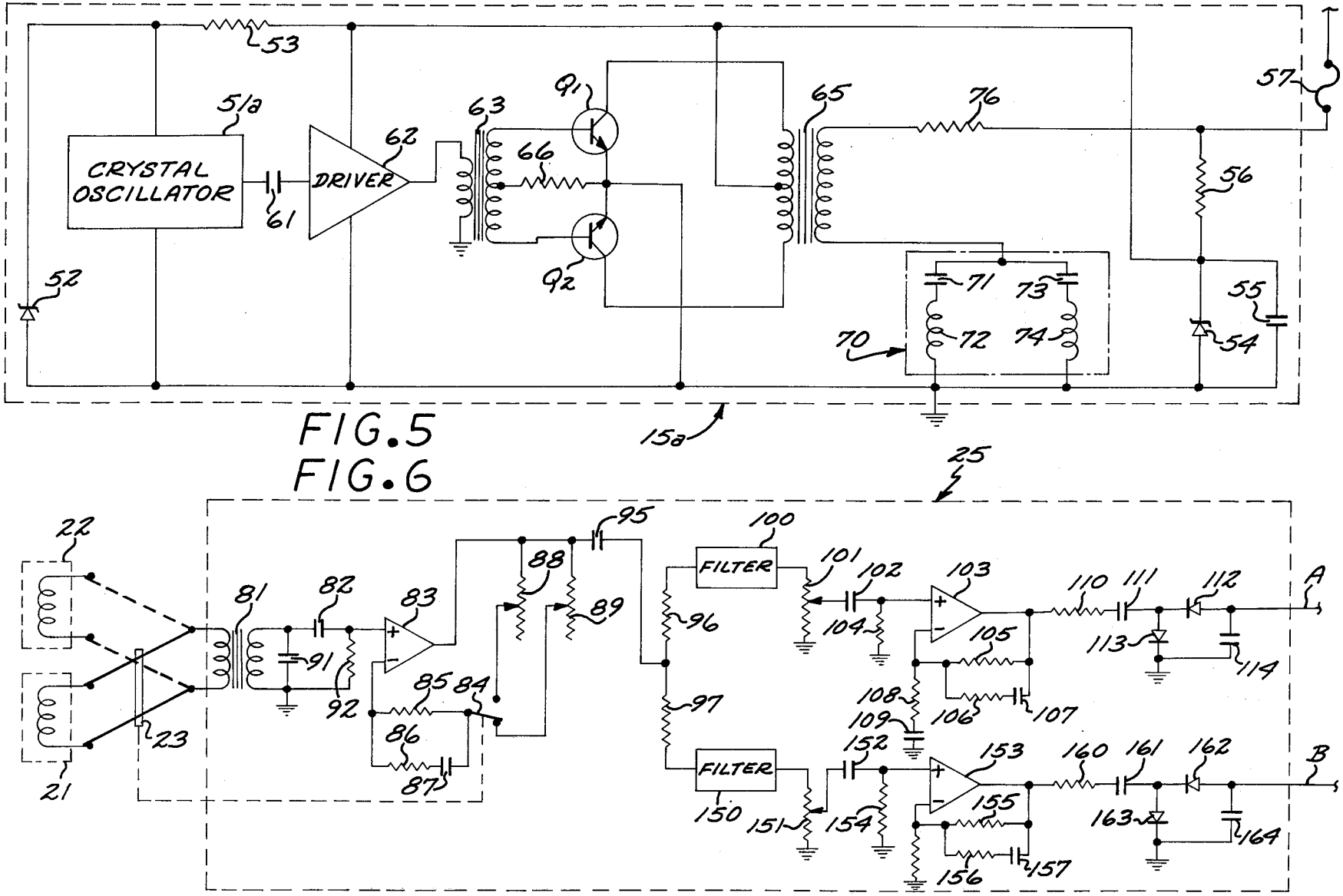
FIG. 5 is a circuit diagram of a typical transmitter utilized in FIGS. 1 and 3.
FIG. 6 is a circuit diagram of an inventive dual frequency trainborne receiver.

As shown in FIG. 5, transmitter 15*a* is illustrated as the typical transmitter. Included in transmitter 15*a* is a crystal oscillator 51*a* having connected thereacross a Zener diode 52. Zener diode 52 sets a supply voltage across the crystal oscillator 51*a*, connecting across a current limiting resistor 53 to the cathode of yet another Zener diode 54. Zener diode 54 is a high voltage Zener diode, such as for example a 50 volt Zener diode, having connected thereacross a capacitor 55. The cathode end of Zener diode 54 furthermore connects across a dropping resistor 56 in circuit with a fuse 57 to the high voltage bus, or the conduit of the track section 11*a* connected to the D.C. power source. The anodes of Zener diodes 52 and 54 and the other side of the crystal oscillator 51*a* and capacitor 55 are connected to a common ground, shown herein as the other conduit of the track section.

Within the same Figure, the crystal oscillator 51*a* is coupled by way of a coupling capacitor 61 to the input of an operational amplifier, or driver, 62. Driver 62 is connected for excitation between the cathode of Zener diode 54 and ground. The output of the driver 62 is coupled by way of a transformer 63 to the base terminals of two transistors Q1 and Q2, the secondary of transformer 63 controlling the transistors which are connected in a push-pull configuration. More specifically, the emitters of transistors Q1 and Q2 are connected to ground and across a resistor 66 to the center tap of the secondary of transformer 63 while the collector terminals thereof connect to two ends of the primary of yet another transformer 65. The primary of transformer 65 is center tapped again to the cathode of the Zener diode 54 such that a D.C. bias of approximately 50 volts is impressed thereon.

The secondary of transformer 65 is connected at one end to ground across a series resonant circuit generally designated by the numeral 70 and comprising two parallel legs including a series connection of a capacitor 71 and inductor 72 in one leg and again a capacitor 73 and inductor 74 in the other leg. The other end of the secondary of transformer 65 connects across a resistor 76 to the fused end of resistor 56.

On the receiver end, the composite signal combination of the signals superposed on the conduits by transmitters 15*a*, 15*b* and 15*c* is picked up either by the front or the rear inductive pickup 21 or 22 according to the position of switch 23.

As shown in FIG. 6, switch 23 is a double pole-double throw switch thrown into the forward position to connect the two leads of pickup 21 to receiver 25. Pickup 21 is a conventional pickup and is represented herein as an inductive coil between the terminals of switch 23. The other end of switch 23 is in turn connected to one end of the primary of a transformer 81 on the input side of the receiver 25. The secondary of the transformer 81 is connected at one end to ground and at the other end across a coupling capacitor 82 to the positive input of an operational amplifier 83. Amplifier 83 is a conventional high gain operational amplifier and is therefore controlled both in bandpass and gain by the feedback loops therearound. Since pickups 21 and 22 are normally not identical in gain, appropriate compensating adjustment of the overall gain of amplifier 83 is therefore necessary for either position of the switch. In this manner, equal signal strength at the output of the amplifier is provided both in the forward and the reverse directions. The compensating adjustment is accomplished by way of yet another two-position switch 84, ganged with switch 23, and connected at its pivot end to a feedback circuit comprising a resistor 85 in parallel with a series circuit including a resistor 86 and a capacitor 87. The other end of resistor 85 and of resistor 86 is brought back to the negative input terminal of amplifier 83. The free end of switch 84 swings between two contacts which connect to the wipers of two potentiometers, respectively 88 and 89. Potentiometers 88 and 89, at one ends thereof, in turn connect to the output of amplifier 83, thus allowing for selective feedback adjustment for either the front or rear pickups.

Thus, the circuit comprising resistors 85, 86 and capacitor 87 in series with either the resistance of potentiometer 88 or potentiometer 89 sets the gain, and, partly, the bandpass range of amplifier 83. Further bandpass control is provided by way of a capacitor 91 connected across the secondary of transformer 81 and a resistor 92 connected between the positive input terminal of amplifier 83 and ground. Since amplifier 83 receives signals in a composite form, the bandwidth thereof must necessarily be sufficiently wide to pass all of the transmitted frequencies. Accordingly, the compensation elements described above provide only a coarse bandwidth selection, its being intended that structure described further hereinbelow provide the discrimination between the bandpasses of the transmitted signals.

At the output, amplifier 83 connects across a coupling capacitor 95 to the center point of a voltage divider formed by an upper resistor 96 and a lower resistor 97. The free end of resistor 96 in turn connects to a narrow bandpass filter 100 which outputs to one end of a potentiometer 101 connected at the other end to ground. Similarly, the free end of resistor 97 connects to yet another filter 150 which again outputs across a potentiometer 151 to ground. The wiper of potentiometer 101 is connected across a coupling capacitor 102 to the positive terminal of an operational amplifier 103, the positive terminal being further connected to ground across resistor 104. The negative terminal connects across a feedback loop to the output of the amplifier 103 comprising a resistor 105 connected in parallel with a series circuit comprising a resistor 106 and a capacitor 107. That same negative terminal furthermore connects to ground by a series circuit comprising a resistor 108 and capacitor 109. Similarly, the wiper of potentiometer 151 connects across a capacitor 152 both to one end of a resistor 154 and to the positive terminal of an operational amplifier 153. Resistor 154 connects at the other end to ground. Operational amplifier 153, in a manner similar to amplifier 103, includes a feedback loop comprising a resistor 155 connected between the negative terminal and the output thereof in parallel with a series circuit comprising resistor 156 and capacitor 157, and is similarly connected to ground across a resistor 158 in series with a capacitor 159.

The combination of filter 100 and amplifier 103, together with the frequency compensating elements around this amplifier, form a narrow bandpass range circuit centered about the frequency of the first bandpass range. The first bandpass in turn includes the signal frequencies generated by transmitters 15*a* and 15*c*. Similarly, filter 150, with amplifier 153, form a second narrow bandpass filter centered about the second bandpass which includes the signal frequency of transmitter 15*b*. In this manner, the two frequency bands are separated according to the general transmitter bands.

The output signal from amplifier 103 is connected across a resistor 110 in series with a capacitor 111 to a rectifying circuit comprising a series connected diode 112, arranged in reverse bias, and a diode 113 connected to ground. Specifically, the cathode of diode 112 connects both to capacitor 111 and the anode of diode 113. The anode of diode 112 provides a rectified signal A, being also connected to ground across a capacitor 114 which takes out any residual ripple. Similarly, the operational amplifier 153 connects across a series circuit comprising resistor 160 and capacitor 161 to the cathode of a diode 162 and to the anode of a diode 163. The cathode of diode 163 is connected to ground while the anode of diode 162 provides a rectified signal B. Any ripple on signal B is similarly taken out by a smoothing capacitor 164.

In this manner, two rectified signals, A and B, are generated corresponding to the output amplitudes from filters 100 and 150. Filters 100 and 150 are conventional passive filters such as the Custom Built LC filters produced by Allen Avionics, Inc., 224 East 2nd Street, Mineola, New York 11501. These filters are generally manufactured to customer order, and it is the bandwidth selection and attenuation of the other frequency that determines the performance thereof. As is conventionally known in the art, if discrimination is made between two distinct frequencies, such is usually made by selective attenuation. In the application herein, it has been found that 40 db attenuation of one frequency at the bandpass of the other frequency is adequate for the purposes described. Furthermore, the filter bandwidth itself, at 3 db attenuation, can be as low as 900 Hertz for transmitting frequencies of 22.5 KHz and 27.5 KHz. Obviously, the filter impedance in both directions is particular to the design selections of the other circuit elements and is conventionally determinable by anyone skilled in the art.

In addition to the filter circuits, the other standard devices are the operational amplifiers 83, 103 and 153. Again, while the selection of these amplifiers is fully within the skill of anyone in the art, and is primarily dictated by design considerations other than those particular to the inventive concept, operational amplifiers Model No. 72709, manufactured by Texas Instruments, Inc., Post Office Box 5012, M.S. 84, Dallas, Texas, have been found useful for this purpose.

Figure 7:
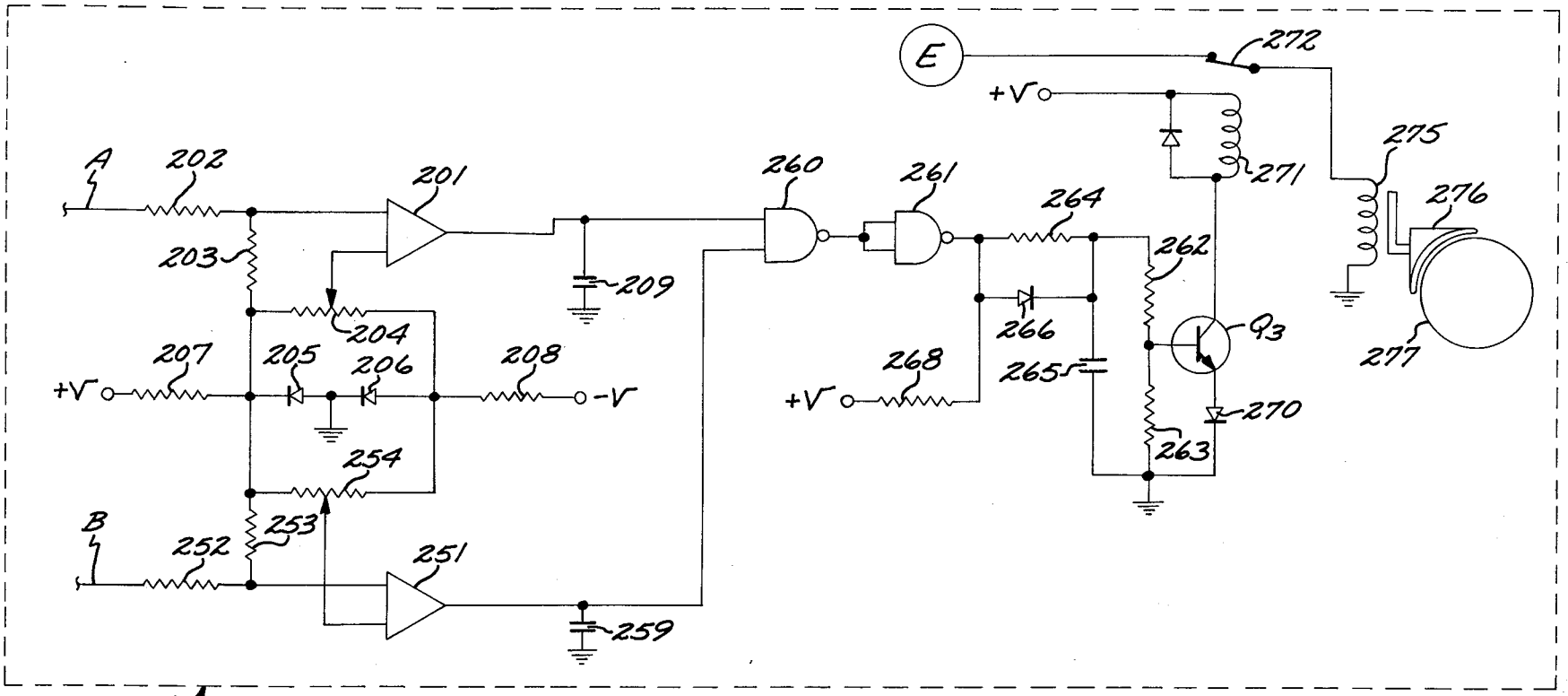
FIG. 7 is a diagram illustrating the control circuitry and mechanical devices responsive to the outputs of the receiver shown in FIG. 6.

As shown in FIG. 7, the rectified signals A and B, representing the signal amplitudes of signals $F_a$ and $F_b$, are in turn connected to the control circuit 40 at the inverting terminals of operational amplifiers 201 and 251, respectively. More specifically, signal A is connected across an input resistor 202 to the inverting terminal of amplifier 201. The inverting terminal of amplifier 201 is also connected across a resistor 203 to one end of a potentiometer 204 which at its wiper is connected to the non-inverting terminal of amplifier 201. The two ends of potentiometer 204, furthermore, connect across a reference voltage circuit comprising two series connected, cathode-to-anode, Zener diodes 205 and 206. Diodes 205 and 206 extend in series between resistors 207 and 208 connected at the other ends to a positive source of electrical signal +V and a negative source of electrical signal −V, respectively. Similarly, signal B is connected across an input resistor 252 to the inverting terminal of an operational amplifier 251. Operational amplifier 251, again at its noninverting terminal, connects to the wiper of a potentiometer 254 which in turn is connected across the same series circuit formed by Zener diodes 205 and 206.

In order to fix the voltage developed across Zener diodes 205 and 206 relative ground, the anode-to-cathode connection between them is tied to ground. The resulting effect thereof is to produce a voltage fixed by the Zener breakdown levels of the diodes which is furthermore centered relative ground. Accordingly, the operational amplifiers 201 and 251 act as comparators, having no gain limiting loops thereabout, and will switch in polarity if the signal at the inverting terminal thereof is greater or exceeds the signal at the noninverting terminal thereof, where the noninverting signal is set by the corresponding potentiometers. Amplifiers 201 and 251 are therefore comparator amplifiers such as Model No. LM311N comparators manufactured by the National Semiconductor Corporation, 2900 Semiconductor Drive, Santa Clara, California.

In order to smooth any residual ripple not taken care of by the rectifying circuits, the outputs of amplifiers 201 and 251 are tied to ground across corresponding smoothing capacitors 209 and 259. The smoothed outputs of amplifiers 201 and 251 are then collected at the input of a NAND gate 260. The output of the NAND gate 260 is in turn inverted by yet another NAND gate 261 connected as a conventional inverter. NAND gates 260 and 261 are noise insensitive gates and may be selected from the Model Series HYNEL 302 NAND gates as produced by the Teledyne Corporation, 147 Sherman, Cambridge, Massachusetts.

The output of NAND gate 261 connects across a resistor 264 to the upper end of a voltage divider comprising resistors 262 and 263 which at the lower end connects to ground. Resistors 262 and 263 are connected in parallel across a large time constant capacitor 265. Furthermore, resistor 264 is in a parallel circuit with a diode 266, in forward bias to ground across capactior 265, where the anode of the diode 266 is also tied across a resistor 268 to the positive electrical signal source +V. In this manner, a charging path, across diode 266, set by the resistance of resistor 268 is provided to capacitor 265. A separate discharge path is in turn provided across resistor 264 during the instances when the output of NAND gate 261 is low. Accordingly, there are two separate time constants, one for charging and one for discharging, determined by the resistive values of resistors 264 and 268.

Thus, when a sufficient separation between trains is sensed, NAND gate 261 goes high as a result of the appearance of two high input signals to NAND gate 260, and capacitor 265 is charged up at a fast charging rate. When the two trains are in dangerous proximity, the NAND gate 261 goes low and capacitor 265 is discharged, however at a slower rate. Thus, in order to reduce spurious stops, the resistance of resistor 264 is intended to be significantly higher than the resistance of resistor 268, thus setting a fast charging rate and a slower discharging rate. The voltage thus developed across the voltage divider formed by the resistors 262 and 263 has a flat rise time and a slow decay time. The division point of the voltage divider so formed then controls the conduction of a transistor Q3 which is connected by the emitter across a diode 270 to ground and includes at its collector a relay winding 271, thus completing the circuit including the winding which on the other end is excited by the signal +V. Relay winding 271, when energized, opens a normally closed switch 272, which in its normally closed position connects a source of electrical excitation E to excite a solenoid 275. Solenoid 275, when excited, maintains brakes 276 away from an engaged position against wheels 277. In order to reduce switching transients, prevent point bounce, and protect transistor Q3, the winding 271 includes a free-running diode 278 thereacross.

As one skilled in the art will perceive, switch 272 is maintained in a normally closed position when winding 271 is not energized. Thus, the excitation to solenoid 275 is continually maintained until such time as braking action is desired. This manner of signal arrangement allows for a fail safe operation mode wherein a loss of any of the signals due to circuit failure will cause the brakes to engage.

In operation, switch 23 is articulated to either the forward or reverse direction, respectively connecting either the front or rear pickup 21 or 22, according to the intended direction of travel of the train. Switch 84, concurrently, is switched to appropriately adjust the gain of amplifier 83. The circuit connected between shoes 31 and 32 therefore is always behind the selected pickup such that the signals sensed are the signals ahead of the train. If there is preceding train shunting the signal from any one of the two transmitters ahead of the following train, and all other transmitters further ahead, the receiver will pick up no more than one signal and the AND condition requiring two signal frequencies is not met. The following train, shown herein as train 20*a*, will then be stopped by the resulting engagement of the brakes.

In any system of this type the possibility of noise temporarily canceling any one of the transmitted signals exists. The random incidents of noise, having any one of the transmitting frequency components over extended durations of time is, however, quite remote. Thus the slow engagement time constant of the brakes acts as an effective noise filter. Should some noise be passed, however, the short disengagement time constant of the brakes limits the amount of power dissipated through the brakes in response to false signals.

In addition to the noixe consideratins, the possibility of signal cancellation by two transmitters operating in the same bandpass is also avoided by the system disclosed herein. More particularly, it is intended that transmitters of the same frequency bandpass range, such as transmiters 15*a* and 15*c*, operate at discrete and separate frequencies. Thus if the bandpass range is centered at 22.5 KHz, for example, and the passing bandwidth of filter 100 is approximately 900 Hz centered at 22.5 KHz, then if transmitter 15*a* operates at a frequency of 22.75 KHz and transmitter 15*c* is at 22.25 KHz, any beats between the signals thereof are at 500 Hz, far above either the response bandwidth of the trains or even the engagement bandwidth of the brakes.

Figure 8:
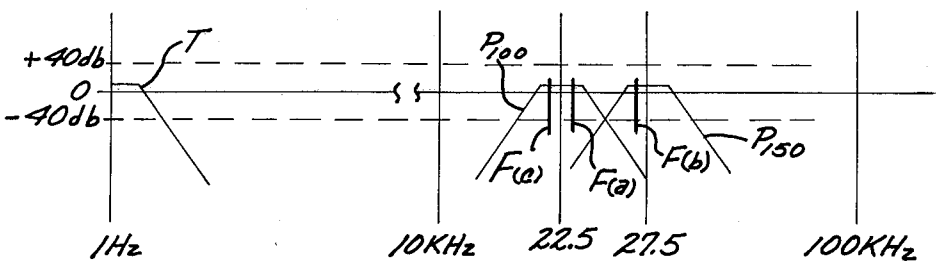
FIG. 8 is a Bode plot illustrating various exemplary frequency responses of the inventive system.

These features are best brought out by reference to FIG. 8, illustrating the Bode plots of the system. Shown therein is a frequency plot T passing frequencies around 1 Hz which corresponds to the brake engagement response bandwidth of trains 20*a* and 20*c*. Separated by many decades therefrom are plots $P_{100}$ and $P_{150}$ corresponding to the frequency response plots of filters 100 and 150, respectively. Superposed within the passing region of plot $P_{100}$ are the discrete frequency signals $F_a$ and $F_c$ generated by transmitters 15*a* and 15*c*. Similarly, signal $F_b$ is within the passing region of plot $P_{150}$. Thus while signals $F_a$ and $F_c$ are separated from signal $F_b$ by filters 100 and 150, the bandwidth of the filters further accommodates separate and discrete frequencies to avoid beats or cancellations.

The many advantages of the present invention should now be readily apparent. The invention provides, by way of simple circuitry, a collision avoidance system which avoids the normally associated problems of noise and various unwanted signal combinations. Furthermore, such advantages are accomplished in a fail safe manner while taking benefit of the shunt formed by the conventionally necessary traction motor.

Obviously, many modifications and variations of the present invention may be made with regard to the foregoing detailed description without departing from the spirit of the invention.

I claim:

1. A collision avoidance system adapted for use in a vehicle for propulsion between conduits emanating from an external source of electrical power, comprising:

a plurality of first and second wayside transmitters, each connected between said conduits, said transmitters superposing corresponding first and second alternating control signals respectively within corresponding first and second frequency bandpass ranges, said first transmitters being interposed between said second transmitters along said conduits;

shunt means disposed in said vehicle, including a traction motor, which receives both said electrical power and said first and second control signals;

pickup means disposed in said vehicle ahead of said shunt means for sensing said first and second control signals;

filter means operatively connected to said pickup means for discriminating between said first and second bandpass range and providing first and second output signals, respectively indicative of the amplitudes of said first and second control signals within said first and second bandpass range; and control means operatively connected to receive said first and second output signals for stopping said vehicle when either one of said output signals falls below a preselected amplitude for a time period greater than a predetermined time period.

2. A system according to claim 1, wherein:

selected ones of said first control signals each comprise a frequency spectrum distinct from the frequency spectra of selected others of said first control signals, said frequency spectra of said one and other first control signals all being contained within said first bandpass range; and selected ones of said second control signals each comprise a frequency spectrum distinct from the frequency spectra of selected others of said second control signals, said frequency spectral of said one and other second control signals all being contained within said second bandpass range.

3. A system according to claim 2, wherein:

said frequency spectra of said one and other first and second control signals are separated by frequency intervals greater than the frequency bandpass range of said predetermined time period.

4. A system according to claim 3, wherein:

said control means includes first and second comparator respectively connected to receive said first and second output signal for producing first and second comparator signals when comparator first and second output signals are above said preselected amplitude, combining means connected to receive said first and second comparator signals for producing a combination signal when both said first and second comparator signals are above said preselected amplitude, and delay means connected to receive said combination signal for producing a brake engagement signal in the absence of said combination signal for a time period greater than said predetermined time period.

5. A system according to claim 4, wherein:

said pickup means includes first and second inductive pickups respectively disposed on either side of said traction motor to communicate with said conduits, and a selector switch adapted to be connected to either one of said first and second pickups to select such pickups as are ahead of said traction motor in the direction of travel of said vehicle.

6. A system according to claim 5, wherein:

said shunt means further includes a capacitor connected across said traction motor.

7. A collision avoidance system, comprising:

a source of external electrical power;

conduits connected to said source;

a plurality of transmitting means connected to said conduits for imposing control signals thereon, each control signal associated with one of said transmitting means being separated from the other ones of said control signal to form a beat frequency greater than a predetermined beat frequency; and a plurality of vehicles each including a traction motor receiving said electrical power and said control signals from said conduits, pickup means disposed ahead of said traction motor for sensing said control signals and control means having a response frequency below said predetermined beat frequency connected to said pickup means for stopping the ones of said vehicles which are receiving said control signals below a preselected amplitude due to the proximity of the other ones of said vehicles.

8. A system according to claim 7, wherein:

said control means includes comparator means having first and second comparator connected to receive said control signals and respectively separating such according to first and second bandpass ranges and for producing first and second comparator signals when said control signals within said first and second bandpass ranges are above said preselected amplitude; and delay means connected to receive said first and second comparator signals at the input of a delay circuit having a response frequency below said predetermined beat frequency.

9. A system according to claim 8, wherein:

said pickup means includes first and second pickups respectively disposed to communicate with said conduits on either side of said traction motor, and a selector switch adapted to connect either said first and second pickups according to the direction of travel of said vehicles.

10. A system according to claim 9, further comprising:

return means connected to said delay means for allowing said vehicles to advance a preselected time constant after said control signals rise above said preselected amplitude, said preselected time constant being less than said predetermined beat frequency.

11. A control signalling system adapted for use in electrical trains powered by connection to electrical conduits, comprising:

a plurality of first and second transmitters alternately connected to said conduits, each correspondingly imposing first and second control signals thereon, said first and second control signals being of discrete and separated frequencies, all of said first control signals being further within a first bandpass range and all said second conrol signals being within a second bandpass range, the frequency separations between said first control signals within said first bandpass range and said second control signals in said second bandpass range being greater than the response bandpass range of said train.

12. A system according to claim 11, wherein:

said trains each include a traction motor which receives electrical power and said first and second control signals from said conduits, front and rear pickup disposed on either side of said traction motor to communicate with said conduits and to sense said first and second control signals, a switch adapted to connect to either one of said front or rear pickups, a receiver connected to said switch for producing first and second output signals indicative of the respective amplitudes of said first and second control signals, first and second comparators means connected to receive said first and second output signals for producing corresponding first and second comparator signals when said first and second output signals are above predetermined amplitudes, and control means connected to receive said first and second comparator signal for stopping said train in the absence of either one thereof.

13. A system according to claim 12, wherein:

said control means includes time delay means for delaying the response thereof by a predetermined time constant, the frequency components of said time constant being less that the frequency separations between aid first and second control signals.

14. A system according to claim 13, wherein:

said receiver includes an amplifier stage connected to receive both said first and second control signals, first and second filters adapted to pass signals at frequencies within said first and second bandpass ranges, and first and second rectifying means connected respectively to the outputs of said first and second filters for producing said first and second output signals.

15. A system according to claim 14 further comprising:

a capacitor connected across said traction motor.

* * * * *